US005324921A

United States Patent [19]

Takarada et al.

[11] Patent Number: 5,324,921

[45] Date of Patent: * Jun. 28, 1994

[54] SHEET COUNTING MACHINE

[75] Inventors: Yuji Takarada, Kawabe; Takao Akioka, Sanda; Hiroyuki Ikeda, Higashi-Osaka; Akio Funato, Kyoto; Shigeru Yonetani, Yamato-Takada, all of Japan

[73] Assignee: Laurel Bank Machines Co., Ltd., Tokyo, Japan

[ * ] Notice: The portion of the term of this patent subsequent to Jun. 14, 2011 has been disclaimed.

[21] Appl. No.: 979,041

[22] Filed: Nov. 19, 1992

[30] Foreign Application Priority Data

Nov. 22, 1991 [JP] Japan ..... 3-308044
Oct. 23, 1992 [JP] Japan ..... 4-286251

[51] Int. Cl.[5] ..... G06M 7/00

[52] U.S. Cl. ..... 235/98 R; 271/3; 271/265; 377/8

[58] Field of Search ..... 235/98 R, 98 A, 98 B, 235/98 C, 1 D; 271/3, 265, 273; 377/8

[56] References Cited

U.S. PATENT DOCUMENTS

| | | | |
|---|---|---|---|
| 3,743,406 | 7/1973 | Komori et al. | 271/3 |
| 4,474,365 | 10/1984 | DiBlasio | 271/3 |
| 4,566,109 | 1/1986 | Sanuga | 377/8 |
| 4,854,757 | 8/1989 | Kikuchi | 271/3 |
| 5,140,138 | 8/1992 | Tanaka | 235/1 D |

FOREIGN PATENT DOCUMENTS 55-6975 2/1980 Japan .

OTHER PUBLICATIONS

Akioka Appln. No. 07/950992, Sheet Counting Machine Sep. 25, 1992.

*Primary Examiner*—Michael L. Gellner
*Assistant Examiner*—Eddie C. Lee
*Attorney, Agent, or Firm*—Cushman, Darby & Cushman

[57] ABSTRACT

A sheet counting machine including a sheet depositing portion into which sheets are deposited, an endless belt for taking out sheets deposited in the sheet depositing portion one by one and feeding them to the inside, a counter for counting the number of sheets fed from the endless belt, a stacker for stacking sheets counted by the sheet counter, an operating portion operated by the operator and a display for displaying various kinds of information, the sheet counting machine further including a first lid member capable of being opened and closed and a second lid member capable of being opened and closed, the operating portion and the display being formed on an inner surface of the first lid member so that the operating portion and the display are not exposed to the outside when the first lid member is closed, the sheet depositing portion being formed so as to be located below the operating portion and the display when the first lid member is opened, the stacker being formed inside of the second lid member when the second lid member is opened in a predetermined manner and being accommodated in the second lid member so as not to be exposed to the outside when the second lid member is closed, and further including control means for controlling the endless belt so as to be driven only when the second lid member is opened in the predetermined manner so that the stacker is formed. The thus constituted sheet counting means can be made considerably compact and freely portable, can .stack sheets in the stacker in a desired manner and can prevent bill jamming.

18 Claims, 11 Drawing Sheets

SHEET COUNTING MACHINE

CROSS REFERENCE TO RELATED APPLICATION

The present invention relates generally to the subject matter of the following prior copending U.S. patent application: Ser. No. 07/950,992, filed on Sep. 25, 1992, entitled "Sheet Counting Machine".

BACKGROUND OF THE INVENTION

The present invention relates to a sheet counting machine and, in particular, to a compact and portable sheet counting machine which can be used for counting sheets anywhere, can stack counted sheets in a desired manner and can prevent sheet jamming.

DESCRIPTION OF PRIOR ART

As disclosed in Japanese Patent Publication No. 55-6975, there is known a sheet counting machine comprising a sheet depositing portion into which sheets are deposited, a sheet feeding means for taking out sheets deposited in the sheet depositing portion one by one and feeding them to the inside, a counting means for counting the number of sheets fed from the sheet feeding means, a stacking means for stacking sheets counted by the sheet counting means, an operating means operated by an operator and a display means for displaying various kinds of information.

In this sheet counting machine, since the sheet depositing portion, the sheet feeding means, the stacking means, the operating means and the display means are fixed to the body of the sheet counting machine so as to be exposed to the outside, the machine is inevitably large and difficult to be carried. When the machine is moved, the operating switches of the operating means, the display panel of the display means and/or the stacking means tend to be damaged by contact with the surrounding objects and, therefore, the machine can be operated only in very restricted places.

Further, in the conventional sheet counting machine, since electrical power for driving the sheet feeding means and the counting means is supplied from an outside power source via a power cord, the machine cannot be operated in places where there is no outside power source or where it is difficult to connect the power cord to the outside power source.

SUMMARY OF THE INVENTION

It is, therefore, an object of the present invention to provide a compact and portable sheet counting machine which can be used for counting sheets anywhere, can stack counted sheets in a desired manner and can reliably prevent sheet jamming.

The above and other objects of the present invention can be accomplished by a sheet counting machine comprising a sheet depositing portion into which sheets are deposited, a sheet feeding means for taking out sheets deposited in the sheet depositing portion one by one and feeding them to the inside, a counting means for counting the number of sheets fed from the sheet feeding means, a stacking means for stacking sheets counted by the sheet counting means, an operating means operated by the operator and a display means for displaying various kinds of information, said sheet counting machine further comprising a first lid member capable of being opened and closed and a second lid member capable of being opened and closed, said operating means and said display means being formed on an inner surface of said first lid member so that said operating means and said display means are not exposed to the outside when said first lid member is closed, said sheet depositing portion being formed so as to be located below said operating means and said display means when said first lid member is opened, said stacking means being formed inside of the second lid member when said second lid member is opened in a predetermined manner and being accommodated in said second lid member so as not to be exposed to the outside when said second lid member is closed, and further comprising control means for controlling said sheet feeding means so as to be driven only when said second lid member is opened in the predetermined manner so that said sheet stacking means is formed.

In a preferred aspect of the present invention, the sheet counting machine further comprises detecting means for detecting whether or not the second lid member is opened in the predetermined manner and outputting a first detection signal to the control means when said second lid member is opened in the predetermined manner so that said sheet stacking means is formed and a second detection signal to said control means when said second lid member is not opened in the predetermined manner and said sheet stacking is not formed, said operating means being adapted for outputting an operating signal to said control means when it is operated by an operator and said control means controlling said sheet feeding means so as to be driven only when said control means receives Said operating signal from said operating means and said first detection signal from said detecting means.

In a further preferred aspect of the present invention, the sheet counting machine further comprises warning means for outputting a warning display signal to said display means when a warning signal is input from said control means, thereby causing said display means to display a warning, said control means being adapted for outputting said warning signal to said warning means when said second detection signal is input from said detecting means while said operating signal is being input from said operating means.

In a further preferred aspect of the present invention, said first lid member, said second lid member and the body of the sheet counting machine are formed so that no projections are formed on the outer surface of the sheet counting machine when said first lid member and said second lid member are closed.

In a further preferred aspect of the present invention, the outer surfaces of said first lid member, said second lid member and the body of the sheet counting machine are formed so that the outer surface of said first lid member is flush with that of the body of the sheet counting machine when said first lid member is closed and that the outer surface of said second lid member is smoothly aligned with that of the body of the sheet counting machine when said second lid member is closed.

In a further preferred aspect of the present invention, said second lid member comprises a sheet stacking plate member and a sheet guide member, said sheet stacking plate member having a stacking surface which is substantially parallel to the direction of sheets discharge when the second lid member is opened and on which the sheets can be stacked, said sheet guide member being slidable with respect to said sheet stacking plate member and having a portion substantially perpendicular to said stacking surface of said sheet stacking plate member.

In a further preferred aspect of the present invention, the sheet counting machine is provided with a battery case for accommodating a battery and with a holder means which detachably accommodates said battery case, an upper surface of said battery case forming a part of said sheet depositing portion when said battery case is accommodated in said holder means.

In a further preferred aspect of the present invention, said upper surface of said battery case is formed with at least one groove and a tray means is supported in the vicinity of an outer end portion of said upper surface of said battery case so as to be openable and closable, said tray means being accommodated in said at least one groove when it is closed and supporting rear edge portions of the sheets deposited into said sheet depositing portion.

In a further preferred aspect of the present invention, the outer surface of said battery case is formed so as to be flush with the outer surface of said body of the sheet counting machine when said battery case is accommodated in said holder means.

The above and other objects and features of the present invention will become apparent from the following description made with reference to the accompanying drawings.

DESCRIPTION OF THE PREFERRED EMBODIMENT

Figure 1:
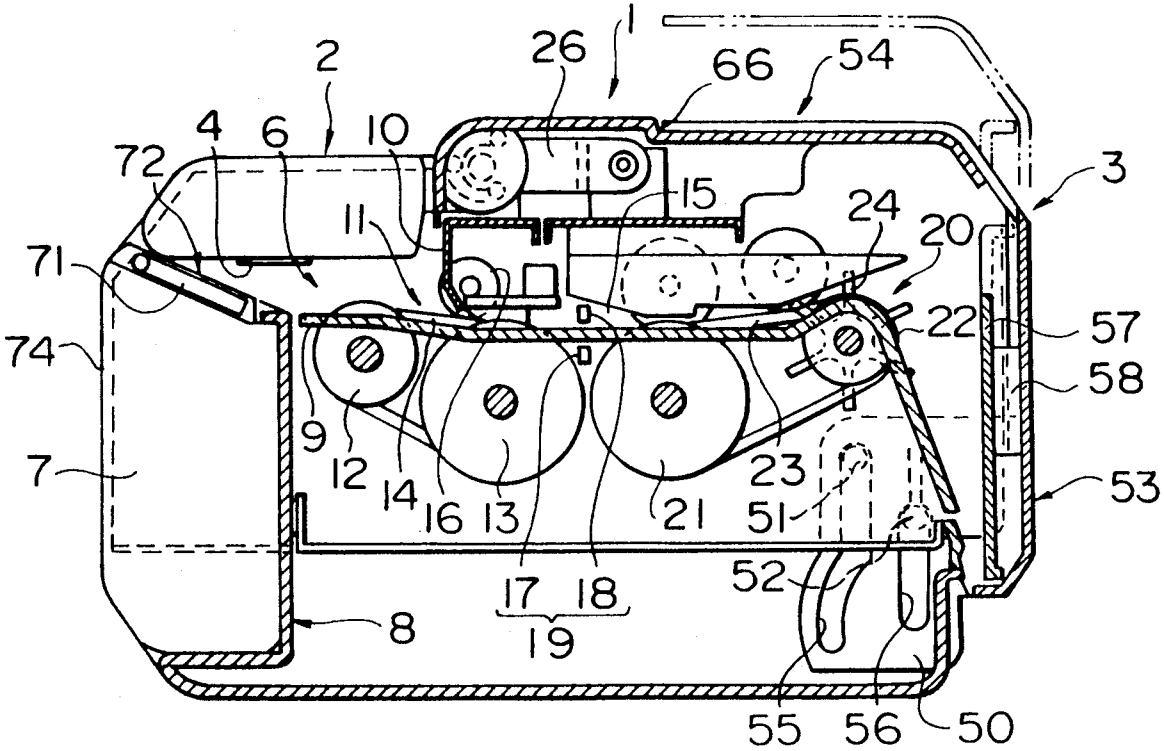
FIG. 1 is a schematic longitudinal cross-sectional view of a bill counting machine which is an embodiment of the present invention.
Figure 2:
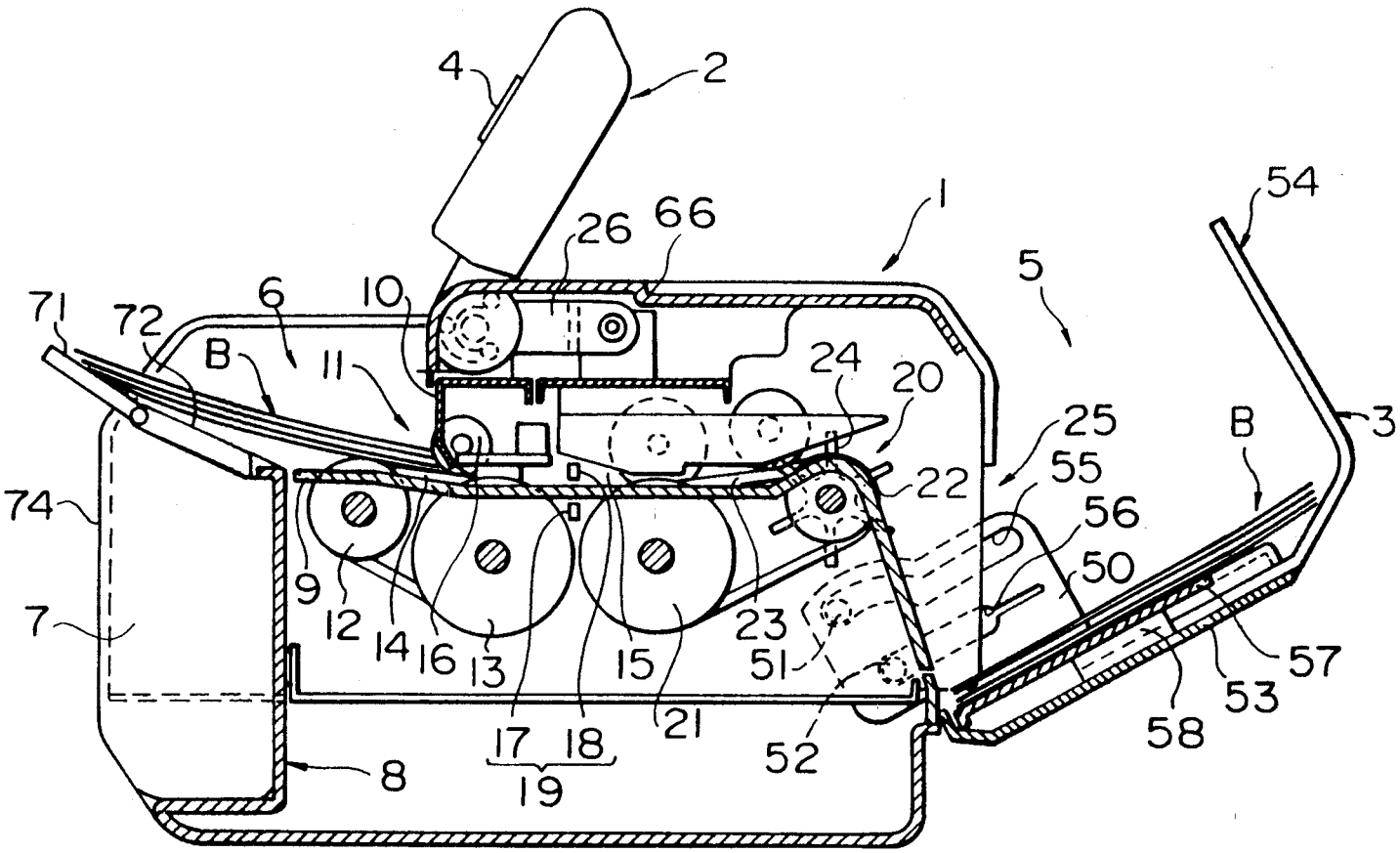
FIG. 2 is a schematic longitudinal cross-sectional view of a bill counting machine which is an embodiment of the present invention, showing the sheet counting machine in operation.

Referring to FIGS. 1 and 2, a bill counting machine which is an embodiment of the present invention comprises a body 1, a first lid member 2 capable of being opened and closed and a second lid member 3 capable of being opened and closed. The first lid member 2 and the second lid member 3 are opened when the bank note counting machine is to be operated. The inner surface 4 of the first lid member 2 is formed with a operating portion (not shown) and a display portion (not shown) so that the operating portion can be operated by the operator and the operator can obtain necessary information from the display portion when the first lid member 2 is opened for operating the bill counting machine. When the second lid member 3 is opened for operating the bill counting machine, a bill stacking portion 5 is formed on the inner surface of the second lid member 3. The body 1 has a shape of a rectangular parellelepiped with its corners being removed, and is formed by, for example, processing and joining plate members of predetermined thickness.

In FIG. 1, a bill depositing portion 6 is shown to be formed below the first lid member 2 and, as shown in FIG. 2, when the first lid member 2 is opened for operating the bill counting machine, the bill depositing portion is opened to the outside and bills B can be deposited into the bill depositing portion 6. Below the bill depositing portion 6, the bill counting machine is formed with a holder 8 for attaching a battery case 7 accommodating a battery as an electrical power source, and the upper portion of the holder 8 is located at substantially the same level as that of a bottom plate 9. The bottom plate 9 and the upper surface of the battery case 7 together form the lower surface of the bill depositing portion 6. The width of the bill depositing portion 6, namely, the common width of the bottom plate 9 and the upper surface of the battery case 7 is made greater than the width of bills B having the greatest width among the bills B to be counted. A gap 11 through which bills B can pass is formed between the bottom plate forming the lower surface of the bill depositing portion 6 and a front plate 10. The bottom plate 9 further extends into the inside of the bill counting machine and is formed with an elongated opening (not shown) from upstream to downstream of the gap 11. An endless belt 14 wound around a pair of pulleys 12, 13 is provided so as to project upwardly from the opening, thereby forming a bill feeding means. The pulley 13, having a larger diameter, is a drive pulley and the pulley 12, having a smaller diameter, driven pulley. As the pair of pulleys 12, 13 are rotated, a frictional force is produced between the lower surface of the lowermost bill B among the bills B deposited into the bill depositing portion 6 and the surface of the endless belt 14 and the bill B is drawn into a bill passage 1 in the bill counting machine through the gap 11. For facilitating the feeding of bills B into the bill passage 15, the diameters and positions of the pair of pulleys 12, 13 are determined so that the endless belt 14 slants slightly downward in the downstream direction. A separation roller 16 is disposed opposite the pulley 13 disposed downstream of the gap 11. The separation roller 16 has a frictional portion on its periphery and is held stationary, so as to ensure that the bills B are fed one by one into the bill passage 15 in the bill counting machine even when two or more bills are simultaneously fed in through the gap 11.

A photosensor 19 comprising a, light emitter 17 and a light receiver 18 is disposed across the bill passage 15 downstream of the pulley 13. When the bill B passes by the portion where the photosensor 19 is disposed, since the light emitted from the light emitter 17 is interrupted by the bill B, it is not received by the light receiver 18, whereby the number of bills B can be counted.

The bottom plate 9 further extends to a bill take-out opening 20 which opens to the bill stacking portion 5 where the bills B counted are to be stacked and is formed with an opening (not shown) which extends from immediately downstream of the photosensor 19 to the bill take-out opening 20. An endless belt 23 wound around a pair of pulleys 21, 22 is provided so as to project upwardly from the opening and each bill B counted by the photosensor 19 is fed to the bill take-out opening 20 by the endless belt 23. The pulley 21, having a larger diameter, is a drive pulley and the pulley 22, having a smaller diameter, is a driven pulley. The diameters and positions of the pair of pulleys 21, 22 are determined so that the endless belt 23 slants slightly upward in the downstream direction.

An accumulating wheel 24 fixed to a common shaft with the driven pulley 22 is provided at the bill take-out opening 20 and is rotated by the endless belt 23 as the drive pulley 21 is rotated. The accumulating wheel 24 is formed of a plurality of rubber or other elastic material blades fixed to the common shaft with the driven pulley 22.

The surface of the body 1 on the side of the bill take-out opening 20 is formed with an opening 25 the width of which is greater than the width of bills having greatest width among the bills B to be counted and, as shown in FIG. 2, when the second lid member 3 is open and the machine is in operation, bills B which have been discharged from the bill passage 15 via the bill take-out opening 20 by the accumulating wheel 24 are stacked in the bill stacking portion 5.

Figure 3:
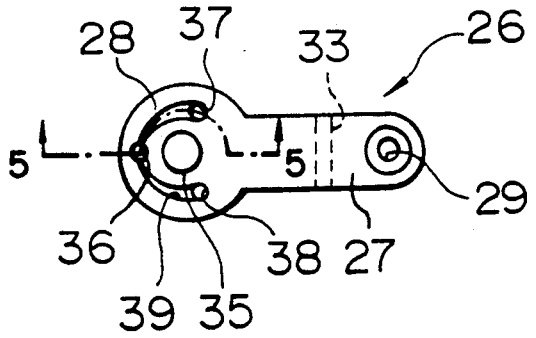
FIG. 3 is a schematic side view of a support member.

A pair of support members 26, 26 are attached to the body 1 above the bill passage 15 for swingably supporting the first lid member 2. FIG. 3 is a schematic view of the support member 26 and FIG. 4 is a schematic view showing a partial lateral cross-section of the first lid member 2 attached to the body 1 by the support member 26.

Figure 4:
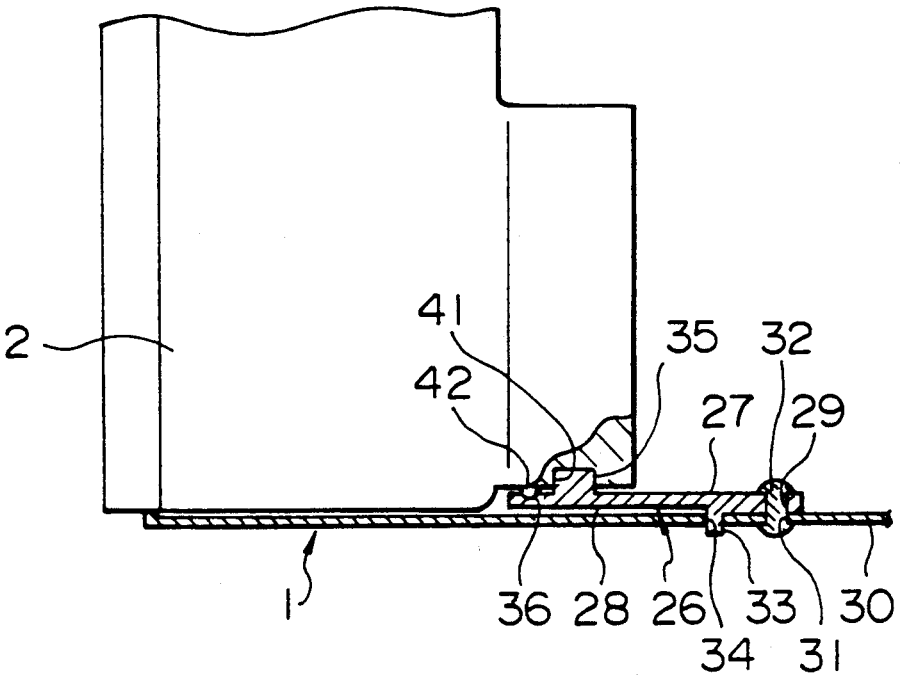
FIG. 4 is a schematic partial lateral cross-sectional view showing a first lid member being attached to a body by a support member.

As shown in FIGS. 3 and 4, the support member 26 is made with a flexible plate and has an elongated portion 27 and a circular portion 28 formed at one end of the elongated portion 27. The elongated portion 27 is formed with an aperture 29 in the vicinity of the end opposite to the circular portion 28. The side portion 30 of the body 1 is formed with an aperture 31 at the position corresponding to the aperture 29 and the support member 26 can be fixed to the side portion 30 of the body 1 by inserting a screw into the aperture 29 and the aperture 31. On the side of the circular portion 28 with respect to the aperture 29, the elongated portion 27 is formed with a projection 33 extending the entire width of the elongated portion 27. On the other hand, the body 1 is formed with a hole 34 having a rectangular shape corresponding to the shape of the projection 33 at the position corresponding to that of the projection 33. Thus, the support member 26-is prevented from being pivoted about the screw 32 by fitting the projection 33 into the hole 34 formed in the body 1. The portion of the support member 26 on the side of the circular portion. 28 with respect to the projection 33 is formed so as to be thinner than that on the side of the aperture 29, whereby as shown in FIG. 4, a clearance is formed between the support member 26 and the side portion 30 of the body 1.

Figure 5:
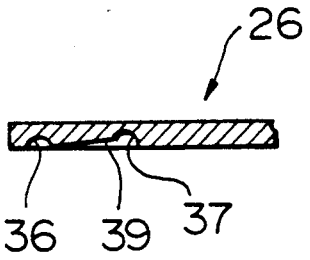
FIG. 5 is a schematic sectional view taken along line A—A in FIG. 3.

At the central portion of the circular portion 28 of the support member 26, a support shaft 35 for swingably supporting the first lid member 2 is formed so as to project in the direction opposite to that of the projection 33. The circular portion 28 around the support shaft 35 is formed with a first concave portion 36 whose center is located on the axis of the support member 26 and is formed with a pair of second concave portions 37, 38 spaced from the first concave portion 36 by 120 degree around the center of the circular portion 28. As shown in FIG. 3 and in FIG. 5, which is a schematic cross-sectional view taken along line A—A in FIG. 3, grooves 39 having a circular arc shape are formed between the first concave portion 36 and the pair of second concave portions 37, 38 such that their width becomes gradually greater and their depth becomes deeper from the first concave portion 36 toward the second concave portions 37, 38.

Figure 6:
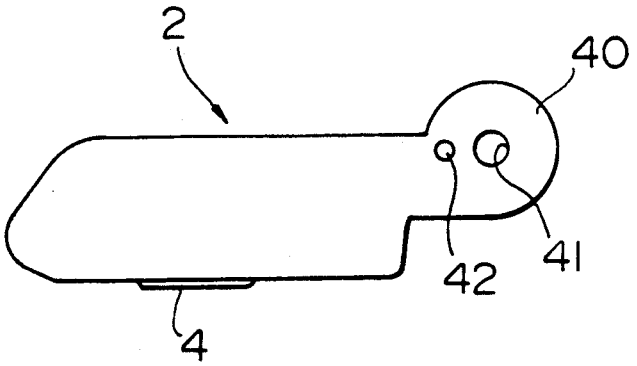
FIG. 6 is a schematic side view of a first lid member.

FIG. 6 is a schematic drawing showing a side view of the first lid member 2. As shown in FIG. 6, one end portion of one side portion of the first lid member 2 is formed with a circular mounting portion 40 having substantially the same diameter as that of the circular portion 28 of the support member 26 and the center portion of the mounting portion 40 is formed with a support hole 41 into which the support shaft 35 of the support member 26 is adapted to fit. Further, the mounting portion 40 is formed with a convex portion 42 adapted for fitting into the first concave portion 36 and the second concave portions 37, 38. The other side portion of the first lid member 2 is formed in the same manner.

When the first lid member 2 is attached to the body 1, the respective support shafts 35, 35 of the support members 26, 26 are caused to fit into the support holes 41, 41 formed in the opposite side portions of the first lid member 2 and the convex portions 42, 42 are caused to fit into the first concave portions 36, 36 of the support members 26, 26, whereby the first lid member 2 and the support members 26, 26 are mounted on the body 1 at a predetermined position. In this state, the first lid member 2 is closed and the operating portion (not shown) and the display portion (not shown) formed on the inner surface of the first lid member 2 are accommodated in the bill depositing portion 6. Therefore, it is possible to carry the bill counting machine without damaging the operating portion and the display portion.

When the first lid member 2 is opened for operating the bill counting machine, since the portion of each support member 26 on the side of the circular portion 28 with respect to the projection 33 is formed so as to be thinner than that on the side of the aperture 29 and so that the rigidity thereof is lower than on the side of the aperture 29 and as shown in FIG. 4, a clearance is formed between the support member 26 and the side portion 30 of the body 1 in the state that the support member 26 is attached to the body 1, the convex portion 42 of the first lid member 2 escapes from the first concave portion 36 and moves toward one of the second concave portions 37, 38 along the groove 39 having a circular arc shape, while it deforms the support member 26 toward the side portion 30 of the body 1. As a result, the first lid member is swung about the support shafts 35, 35 of the support members 26, 26 and is opened. When each of the convex portions 42, 42 of the first lid member 2 fits into one of the second concave portions 37, 38, the first lid member 2 is fixed at that position and the bill depositing portion 6 of the bill counting machine is opened, whereby the bill counting machine is ready to be operated. The reason why two second concave portions 37, 38 are formed in each support member 26 is to make it possible to use similarly designed members for the support members 26, 26 to be attached to the opposite side portions of the body 1.

Figure 7:
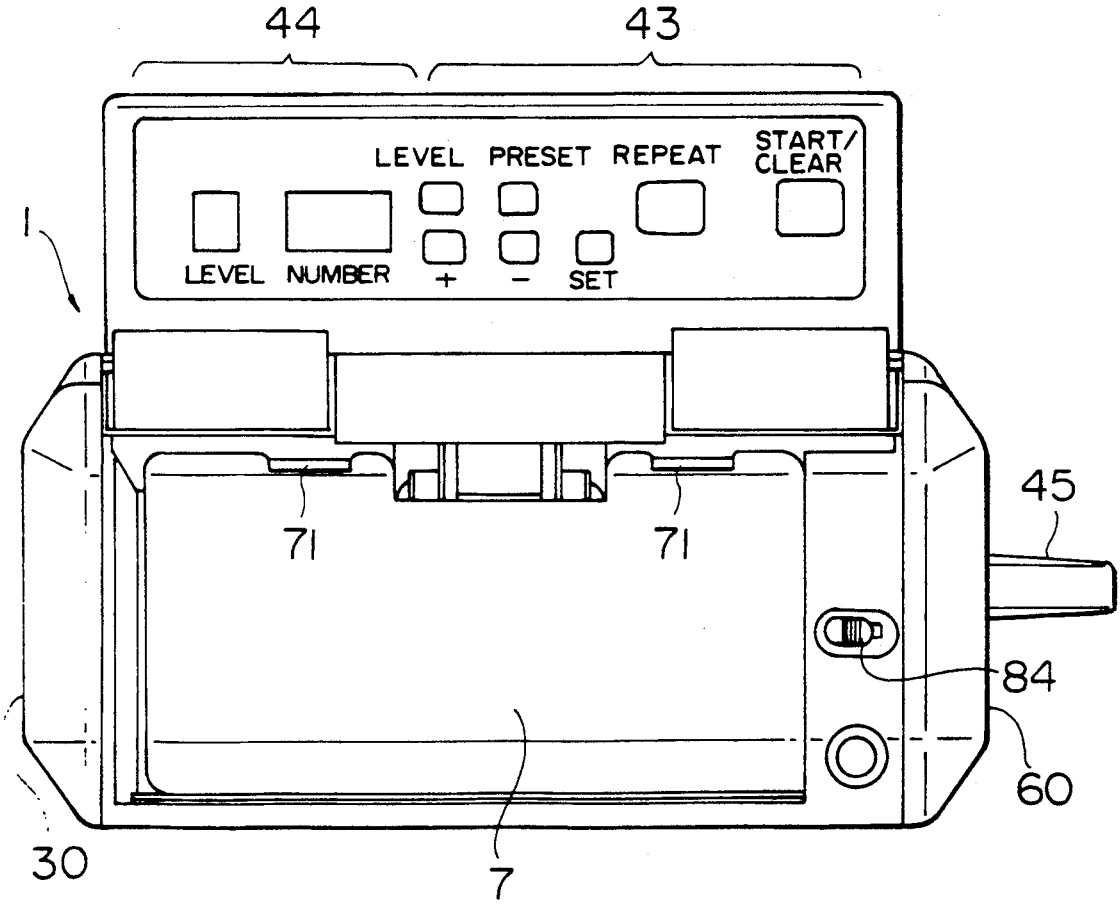
FIG. 7 is a schematic front view showing a bill counting machine ready for operation.

FIG. 7 is a schematic front view of the bill counting machine with the first lid member 2 opened and the bill counting machine ready to be operated. As shown in FIG. 7, when the first lid member 2 is opened, the operating portion 43 and the display portion 44 formed on the inner surface of the first lid member 2 are exposed to the outside so that the operating portion 43 is located at a position for operation by an operator and that the operator can read information displayed on the display portion 44. In FIG. 7, the reference numeral 45 designates a handle used for carrying the bill counting machine.

On the other hand, when the first lid member 2 is closed for making the bill counting machine portable, the convex portion 42 of the first lid member 2 escapes from one of the second concave portions 37, 38 and moves toward the first concave portion 36 along the groove 39 having a circular arc shape, while it deforms the support member 26 toward the side portion 30 of the body 1. As a result, the first lid member is swung about the support shafts 35, 35 of the support members 26, 26 and is closed. When each of the convex portions 42, 42 of the first lid member 2 fits into one of the first concave portions 36, the first lid member 2 is fixed at that position. Since the grooves 39 having a circular arc shape are formed between the first concave portion 36 and a pair of the second concave portions 37, 38 such that their width becomes gradually greater and their depth becomes deeper from the first concave portion 36 toward the second concave portions 37, 38, the convex portions 42 can escape from the second concave portion 37 or 38 with a small amount of deformation of the support members 26 for closing the first lid member 2. Thus, it is possible to make the bill counting machine portable by closing the first lid member 2 with a small force.

Since, as shown in FIGS. 1 and 6, the outer surface of the first lid member 2 is formed so as to be flush with the outer surface of the body 1 of the bill counting machine, the first lid member is prevented from being damaged when the bill counting machine is being carried, and since the operating portion 43 and the display portion 44 are formed on the inner surface of the first lid member 2 and they can be accommodated in the bill depositing portion 6 when the bill counting machine is not in operation, it is possible to make the bill counting machine markedly compact, and thus easy to carry and operate at any desired place.

The second lid member 3 is also constituted so as to be open when the bill counting machine is being operated and closed when it is not being operated. As shown in FIGS. 1 and 2, the inner surfaces of the opposite side portions 30, 60 of the body 1 are respectively formed with first pins 51 and the inner surfaces of the opposite side portions 30, 60 below the first pins are respectively formed with second pins. 52. On the other hand, as shown in FIG. 2, the second lid member 3 comprises a bill stacking plate 53 having a surface which is substantially parallel with the direction in which bills B are discharged through the bill take-out opening 20 when the second lid member 3 is open, and a bill guide plate 54 having a reverse L-shape and a surface which is substantially perpendicular to the surface of the bill stacking plate 53 when the second lid member 3 is open and slidable with respect to the bill stacking plate 53. Hinge plates 50, 50 are fixed to the opposite end portions of the bill stacking plate 53 so as to be perpendicular to the surface of the bill stacking plate 53 and each of the hinge plates 50, 50 is formed with a first guide slot 55 into which the first pin 51 can be inserted and a second guide slot 56 into which the second pin 52 can be inserted. The second guide slot 56 into which the second pin 52 can be inserted is straight and elongated, and the first guide slot 55 into which the first pin 51 can be inserted has a straight, elongated section that is parallel with the second guide slot 56 and an arcuate elongated section and connected with the lower end of the straight, elongated section. The length of the straight, elongated section of the first guide slot 55 is made slightly shorter than that of the straight, elongated section of the second guide slot 56. The widths of the bill stacking plate 53 and the bill guide plate 54 are made greater than the width of bills B having the greatest width among the bills B to be counted.

Figure 8:
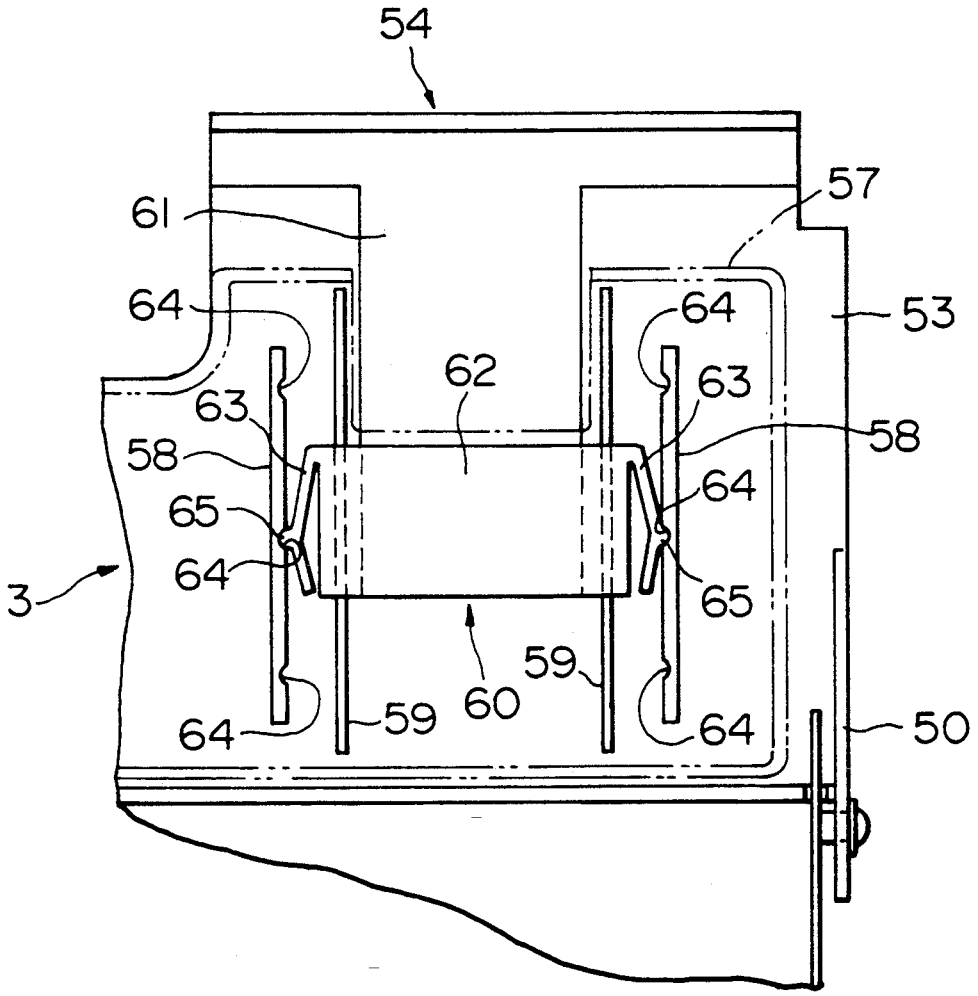
FIG. 8 is a schematic drawing showing a second lid member.

The second lid member 3 is formed symmetrically with respect to the center axis of the bill counting machine. This is why the schematic plan view of FIG. 8 shows only the right half of the second lid member 3 and the left half is omitted. As shown in FIGS. 1, 2 and 8, a tray 57 is fixed to the inside portion of the hinge plates 50, 50 for receiving on it upper surface bills B which have been counted and fed out through the bill take-out opening 20. In FIG. 8, the tray is indicated by a phantom line. The tray 57 is connected to the surface of the bill stacking plate 53 via four mutually parallel beams 58,. 58, 58, 58 and two sets of guide rails, one of which consists of a pair of guide rails 59, 59 fixed to the surface of the bill stacking plate 53 inside of two beams 58, 58 provided on the right half with respect to the center axis of the bill counting machine and the other of which consists of a pair of guide rails 59, 59 inside two beams 58, 58 provided on the left half. A slide member 60 is supported on each set of guide rails 59, 59 and the extending portion 61 of the bill guide plate 54 extending substantially parallel with the surface of the bill stacking plate 53 is fixed to the lower surface of the slide member 60 so as not to interfere with the guide rails 59, 59. Each slide member 60 comprises a body portion 62 and a pair of branch portions 63, 63 each branching from the body portion 62 and having a bend. Each branch portion 63 is made of a flexible material and biased against the guide rail 59 located outside thereof with respect to the body portion 62 by its own flexibility.

Figure 9:
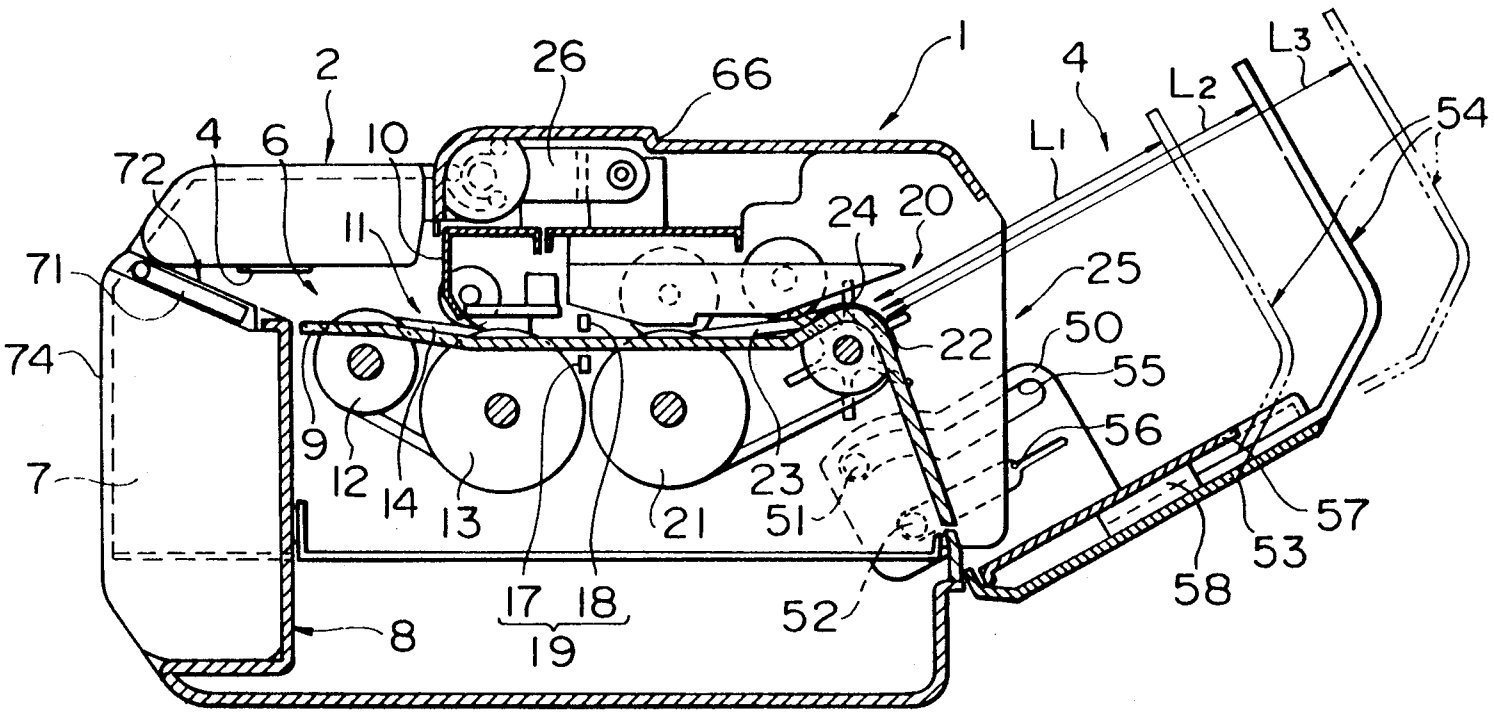
FIG. 9 is a schematic longitudinal cross-sectional view of a bill counting machine in operation.

The surfaces of the set of the beams 58, 58 on the side of the guide rails 59, 59 are formed with substantially equally spaced semi-cylindrical concave portions 64, 64, 64 and, on the other hand, the bent portion of each branch portion 63 of the slide member 60 closest to the beams 58 is formed with a semi-cylindrical convex portion 65 adapted to fit into the semi-cylindrical concave portions 64, 64, 64. Since each of the branch portions 63, 63 of the slide member 60 is biased against the beam 59 located outside thereof with respect to the body portion 62 by its own flexibility, when the semi-cylindrical convex portions 65, 65 fit into certain semi-cylindrical concave portions 64, 64, the bill guide member 54 is fixed at the corresponding position and when a force parallel with the guide rails .59, 59 acts on the slide member 60, the branch portions 63, 63 are deformed and the semi-cylindrical convex portions 65, 65 escape from the semi-cylindrical concave portions 64, 64 of the beams 59, 59, Whereby the slide member 60 is moved along the guide rails 59, 59 until the semi-cylindrical convex portions 65, 65 fit into other semi-cylindrical concave portions 64, 64 to be fixed at that position. Therefore, as shown in FIG. 9, it is possible to adjust the size of the bill stacking portion 5 in accordance with the size of bills B to be stacked on the tray 57 of the bill stacking plate 53 and to stack bills B in the bill stacking portion 5 in a desired manner.

If with the bill counting machine in the state where the second lid member 3 is closed as shown in FIG. 1, the second lid member 3 lifted to open it in preparation for operating the bill counting machine, the first pin 51 will be guided by the straight, elongated section of the first guide slot 55 and the second pin 52 will be guided by the second guide slot 56 having the straight, elongated section. As a result, the second lid member 3 is moved upwardly as indicated by phantom lines in FIG. 1. Since the length of the straight, elongated section of the first guide slot 55 is slightly shorter than that of the straight, elongated section of the second guide slot 56, when the second pin 52 reaches the lower end portion of the second guide slot 56, the first pin 55 is located at the upper end portion of the arcuate elongated section of the first guide slot 55 and, therefore, when the second lid member 3 is further lifted upwardly, since the first pin 51 moves along the arcuate elongated section of the first guide slot 55, the second lid member 3 swings about the second pin 52 located at the lower end portion of the second guide slot 56 until the first pin 51 reaches the lower end portion of the arcuate elongated section of the first guide slot 55, and opens as shown in FIG. 2.

In this state, the semi-cylindrical convex portions 65, 65 fit into the lowest concave portions 64, 64 in FIG. 8 and, therefore, the length of the bill stacking portion 5 is the shortest. In this embodiment, as shown in FIG. 9, the length of the bill stacking portion 5 can be changed in three stages L1, L2 and L3, and the bill counting machine is designed so that the counting of bills B is started after the length of the bill stacking portion 5 is set greater than that of bills B having the greatest length among those to be counted by, moving the slide member 60 and causing the semi-cylindrical convex portions 65, 65 to fit into the desired concave portions 64, 64. As a result, since when the counting of bills B is started, the bill guide plate 54 substantially perpendicular to the bill stacking plate 53 is located at a position that is spaced from the bill take-out opening 20 by a distance greater than the length of bills B having the greatest length among those to be counted, it is possible to prevent bills B which have been counted and discharged through the bill take-out opening 20 from jumping out from the bill stacking portion 5 and to ensure that they are reliably stacked in the bill stacking portion 5.

After the counting and stacking of the bills B have been completed in this manner and the bills B have been removed from the bill stacking portion 5, if the bill counting machine is not to be used further at this time, the semi-cylindrical convex portions 65, 65 of the slide member 60 are caused to fit into the lowermost concave portions 64, 64 in FIG. 8, thereby setting the bill stacking portion 5 to its shortest length and the second lid member 3 is closed by an operation that is the reverse of that for opening it. The body 1 is formed with a step 66 so that the bill guide plate 54 is accommodated in the lower portion when the second lid member 3 is closed and that the outer surface of the bill counting machine becomes flush.

Figure 10:
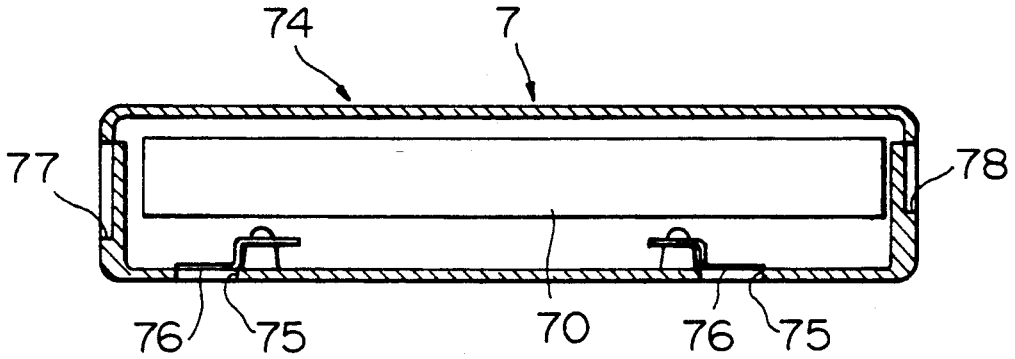
FIG. 10 is a schematic lateral cross-sectional view of a battery case accommodating a battery.
Figure 11:
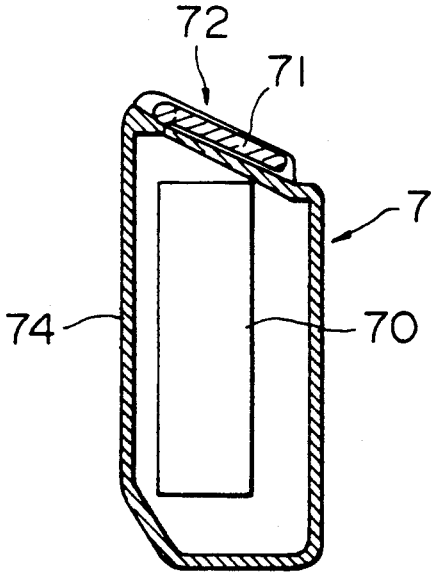
FIG. 11 is a schematic longitudinal cross-sectional view of a battery case accommodating a battery.
Figure 12:
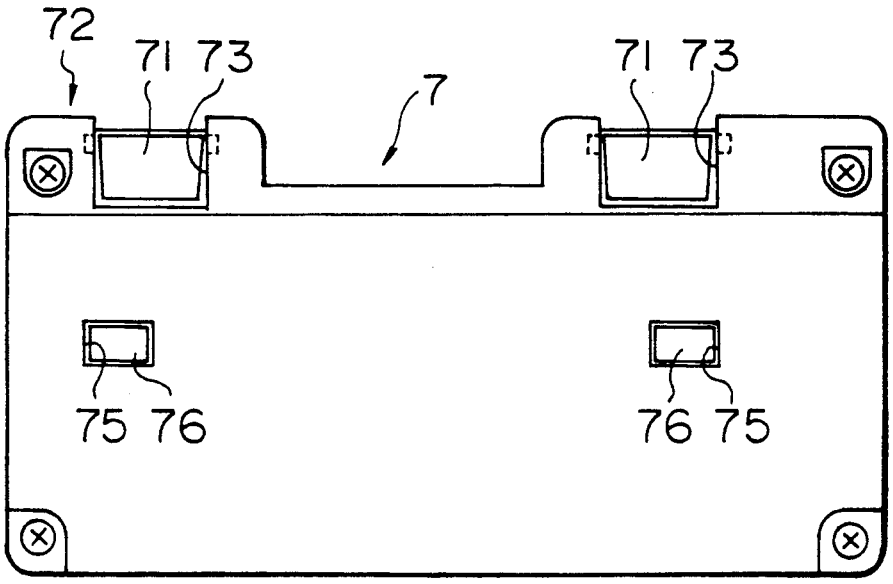
FIG. 12 is a schematic right side view of FIG. 11.

FIG. 10 is a schematic view of a battery case 7 accommodating a battery 70, FIG. 11 is a schematic longitudinal view thereof and FIG. 12 is a schematic right side view thereof.

As shown in FIGS. 10, 11 and 12, the battery case 7 accommodating a battery 70 can fit into the holder 8 and the outer surface thereof is flush with the outer surface of the bill counting machine when the battery case 7 fits into the holder 8. Further, as shown in FIG. 12, a pair of trays 71, 71 are secured to the upper surface of the battery case 7 in the vicinity of outer end portions thereof by pins or the like so as to be openable and closable. When the trays 71, 71 are closed, they are accommodated in a pair of grooves 73, 73 formed on the upper surface 72 of the battery case 7 so that, with the level of their upper surfaces substantially the same as that of the upper surface of the battery case 7, they form a bottom portion of the bill depositing portion 6 together with the upper surface 72 of the battery case 7. The upper surface 72 of the battery case 7 is formed to incline downwardly with respect to the feeding direction of bills B so as to enable bills B to be fed by the endless belt 14 from the gap 11 into the bill passage 15. When the trays 71, 71 are closed and the first lid member 2 is closed, the first lid member 2 abuts against the upper surface 72 of the battery case 7 and the outer surface of the first lid member 2 is flush with the outer surface 74 of-the battery case 7.

The pair of trays 71, 71 is swingable counterclockwise in FIG. 11 by about 170 to 180 degrees and when the trays 71, 71 are swung and opened,.they project outwardly as shown in FIG. 2, thereby forming the bottom portion of the bill depositing portion 6. By supporting the rear edges of longer bills B, they ensure that the bills B are reliably fed into the bill counting machine.

As shown in FIGS. 10 and 12, the inner side portion 80 of the battery case 7 is formed with a pair of rectangular connecting holes 75, 75 for enabling the bill counting machine to electrically connect with the battery 70 and terminals 76,-76 electrically connected to the battery are provided on the inner surface of the battery case 7 in the vicinity of the connecting holes 75, 75. The electrical connection between the battery 70 and the terminals 76, 76 is conventional and will not be described.

As shown in FIG. 10, the opposite side surface of the battery case 7 is formed with engaging grooves 77, 78 for engaging the battery case 7 with the holder 8.

Figure 13:
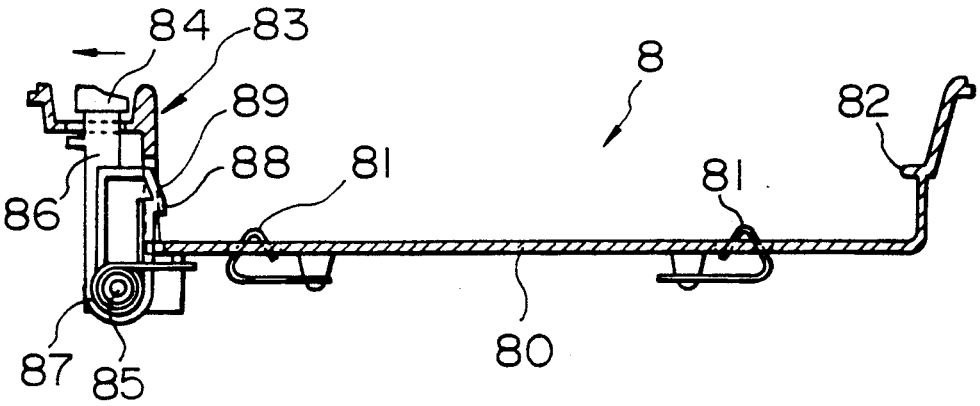
FIG. 13 is a schematic lateral cross-sectional view of a holder.

FIG. 13 is a schematic lateral cross-sectional view of the holder 8. As shown in FIG. 13, the inner side portion 80 of the holder 8 is provided with contact terminals 81, 81 adapted for electrically connecting with the terminals 76, 76 in the connecting holes 75, 75 of the battery case 7. An engaging member 82 provided at one side of the holder 8 projects into the holder 8 to be engageable with the engaging groove 78. The other side is provided with an engagement mechanism 83 for detachably retaining the battery case 7.

The engagement mechanism 83 is provided with an operation member 84 shown in FIG. 7 at one end, which can be operated from the outside of the bill counting machine, and a lever 86 which is swingably supported by a support shaft 85. The lever 86 is biased clockwise in FIG. 13 by a coil spring 87. The lever 86 is integrally formed with a catch 88 having an inclined surface 89 which projects deeper into the holder 8 with increasing proximity to the inner side portion 80 of the holder 8. The catch 88 normally projects into the holder 8 and engages with the engaging groove 77 of the battery case 7.

When an operator moves the operating member 84 to the left in FIG. 13, the lever 86 is swung counterclockwise about the support shaft 85 against the spring force of the coil spring 87. As a result, the catch 88 is also moved to the outside of the holder 8, whereby the engagement between itself and the engaging groove 77 is released and it becomes possible to detach the battery case 7 from the holder 8.

Figure 14:
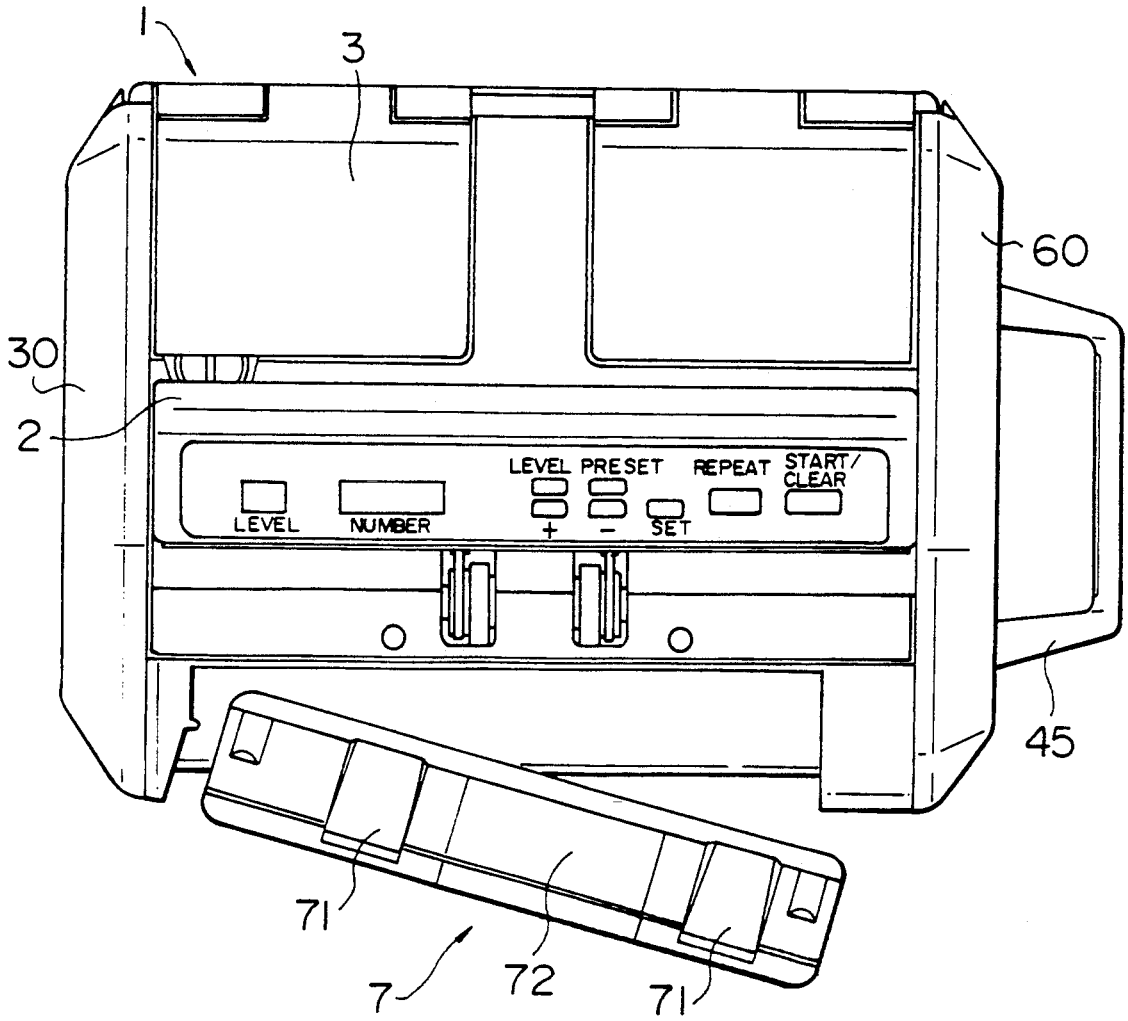
FIG. 14 is a schematic plan view of a sheet counting machine, showing how a battery case is detached/attached from/to a holder.

One the other hand, when the battery case 7 is to be attached to the holder 8, the engaging groove 78 is first engaged with the engaging member 82 of the holder 8 and the battery case 7 is then pushed into the holder 8. As a result, the inclined surface 89 of the catch 88 is pressed by the battery case 7 and the lever 86 is swung counterclockwise about the support shaft 85 against the spring force of the coil spring 87. When the engaging groove 77 of the battery case 7 reaches a position where it can engage with the catch 88, the engaging groove 77 of the battery case 7 and the catch 88 engage with each other and the terminals 76, 76 in the battery case 7 contact the contact terminals 81, 81 of the holder, enabling the battery 70 to supply the electrical power required for operating the bill counting machine. FIG. 14 is a schematic plan view of the bill counting machine showing the battery case 7 being detached from or attached to the holder 8.

Figure 15:
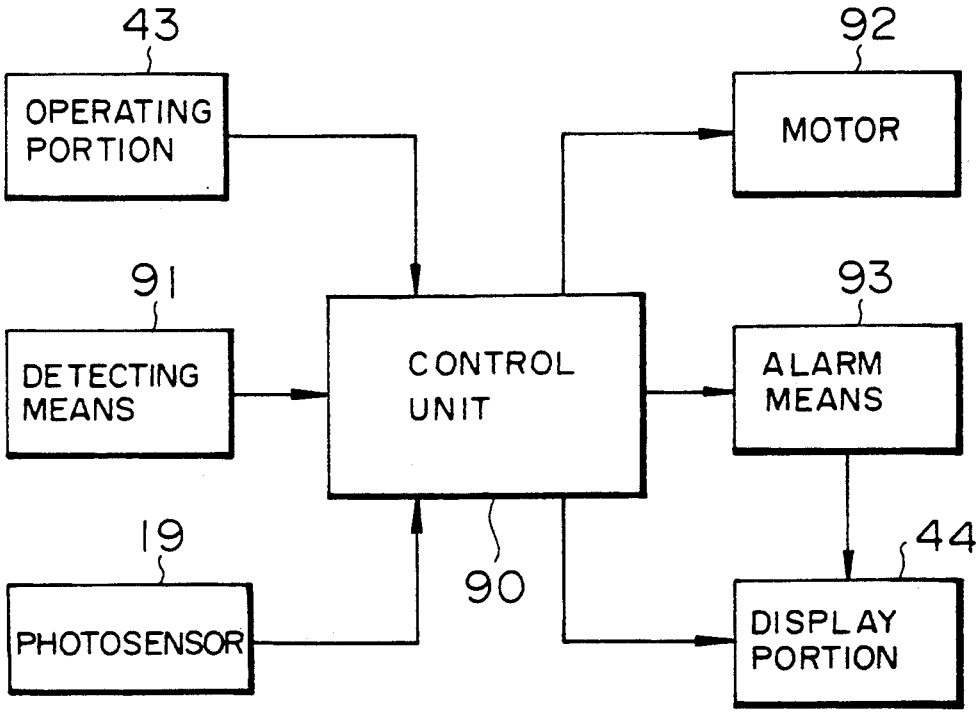
FIG. 15 is a block diagram showing a control system, a detecting system and a display system of a bill counting machine which is an embodiment of the present invention.

FIG. 15 is a block diagram showing a control system, a detecting system and a display system of the bill counting machine which is an embodiment of the present invention.

In FIG. 15, the control system of the bill counting machine which is an embodiment of, the present invention comprises a control unit 90. The detecting system of the bill counting machine which is an embodiment of the present invention comprises a detecting means 91 for detecting whether or not the second lid member 3 is opened in the desired manner. The detecting means 91 is adapted for outputting a first detection signal to the control unit 90 when the second lid member 3 is opened in the desired manner and outputting a second detection signal to the control unit 90 when the second lid member 3 is closed or is not opened in the desired manner. The display system of the bill counting machine which is an embodiment of the present invention comprises the display portion 44 adapted for displaying information required by the operator. The control unit 90 receives an operating signal from the operating portion 43 and a counting signal from the photosensor 19. Based upon these input signals, the control unit 90 outputs a display signal to the display portion 44 and a drive signal to a motor 92 and is adapted for outputting a warning signal to a warning means 93 when a second detection signal is input from the detecting means 91 and it can be considered that the second lid member 3 is not opened in the desired manner although an operating signal is input from the operating portion 43 as a result of the operating means 43 being operated by the operator. The warning means 93 is adapted for outputting a warning display signal to the display means 44 when it receives a warning signal from the control unit 90 and causing the display means 44 to display a warning and to sound a warning sound.

The thus constituted bill counting machine is controlled in the following manner.

When the operating portion 43 is operated by the operator, an operating signal is input to the control unit 90. At this time, if a first detection signal has been input from the detection means 91, since it can be considered that the second lid member 3 is opened in the desired manner, it is possible to stack counted bills in the bill stacking portion 5 formed on the inner surface of the second lid member 3 in a desired manner by effecting the counting of bills. Therefore, the control unit 90 outputs a drive signal to the motor 92, thereby starting the counting of bills.

On the contrary, when a second detection signal has been input from the detection means 91, it can be considered that the second lid member 3 is not opened in the desired manner. In this situation, if the counting of bills is effected in response to an operating signal input from the operating portion 43 to the control unit 90, counted bills cannot be stacked in the bill stacking portion 5 in a desired manner and, as a result, bill jamming may occur in the bill counting machine. Therefore, the control unit 90 outputs a warning signal to the warning means 93 without outputting a drive signal to the motor 92. As a result, a warning display signal is sent from the warning means 93 to the display means 44, whereby a warning is displayed in the display means 44 and a warning is sounded. Accordingly, the operator can recognize the fact that the second lid member 3 is not opened in the desired manner and can open it in the desired manner to start the counting of bills.

After the counting of bills has started, when the situation changes for some reason so that the second lid member 3 is not opened in the desired manner and the second detection signal is input from the detecting means 91 to the control unit 90, if the bill counting operation continues, there is some risk of counted bills not being stacked in the bill stacking portion 5 in the desired manner and of bill jamming occurring in the bill counting machine. Therefore, the control unit 90 outputs a drive stop signal to the motor 92 thereby to stop the motor 92 and outputs a warning signal to the warning means 93. As a result, a warning display signal is output from the warning means. 93 to the display means 44, whereby a warning is displayed in the display means 44 and a warning is sounded. Accordingly, the operator can recognize the fact that the second lid member 3 is not opened in the desired manner and can open the second lid member 3 in the desired manner to restart the counting of bills.

According to this embodiment, when the bill counting machine is not in use, since the first lid member 2 which forms the bill depositing portion 6 when it is opened and the second lid member 3 which forms the bill stacking portion 5 when it is opened are closed and the bill depositing portion 6 and the bill stacking portions are accommodated in the bill counting machine, the bill counting machine can be made markedly compact and since the outer surfaces of the body 1, the first lid member 2, the .second lid member 3 and the holder 8 are formed so as to be flush with each other, there is little risk of the bill counting machine being damaged, whereby the bill counting machine can be readily carried to any desired location. Further, since the battery case 7 accommodating the battery 70 can be attached to and detached from the bill counting machine, the bill counting machine can be operated even in places where no outside electrical power source is available or where it is impossible to connect the power cord with the outside electrical power source. Furthermore, if the second lid member 3 is not opened in the desired manner and the bill stacking portion 5 is not formed on the inner surface of the second lid member 3 in the desired manner, the bill counting operation is prohibited and only when the second lid member 3 is opened in the desired manner and the bill stacking portion 5 is formed on the inner surface of the second lid member 3 in the desired manner, is the counting of bills effected. Therefore, it is without fail possible to stack bills in the bill stacking portion 5 in the desired manner and to prevent bill jamming from occurring in the bill counting machine.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although the outer surfaces of the .body 1, the first lid member 2, the second lid member 3 and the holder 8 are formed so as to be flush with each other, this not essential if there is little risk of the bill counting machine being damaged and it is possible in such cases to form the bill counting machine only to be free of projections on the outer surface thereof.

Further, in the above described embodiment, although the surface of each of set of beams 58, 58 on the side of the guide rails 59, 59 is formed with three substantially equally spaced semi-cylindrical concave portions 64, 64, 64 so that the length of the bill stacking portion 5 can be changed in three stages L1, L2 and L3, the number of the semi-cylindrical concave portions 64, 64, 64 is not limited to three and it is not necessarily required to form the semi-cylindrical concave portions 64, 64, 64 at regular intervals.

Furthermore, in the above described embodiment, although the second concave portions 37, 38 are formed around the center of the circular portion 28 so as to be spaced from the first concave portion 36 by 120 degree and the position of the first lid member 2 when it is opened is determined by using only one of the second concave portions 37, 38, it is unnecessary to form two second concave portions 37, 38 and it is further possible by .forming two or more second concave portions to be used for stopping the first lid member 2 at multi-stages when it is opened.

Moreover, although the invention was explained with respect to a bill counting machine for counting bills as an embodiment, the present invention can also be applied to sheet counting machines for counting sheets other than bills.

Further, in the present invention, the respective means need not necessarily .be physical means and arrangements whereby the function of the respective means are accomplished by software fall within the scope of the present invention. In addition, the function of a single means may be accomplished by two or more physical means and the functions of two or more means may be accomplished by a single physical means.

In the claims:

1. A sheet counting machine comprising:

a sheet depositing portion into which sheets are deposited, counting means, sheet feeding means for taking out sheets deposited in the sheet depositing portion one by one and feeding the taken-out sheets to said counting means for counting the number of sheets fed from the sheet feeding means, stacking means for stacking sheets counted by the sheet counting means, operating means operated by an operator, display means for displaying various kinds of information, said sheet counting machine further comprising a first lid member capable of being opened and closed and a second lid member capable of being opened and closed, said operating means and said display means being formed on an inner surface of said first lid member so that said operating means and said display means are not exposed externally of said first lid member when said first lid member is closed, said sheet depositing portion being formed so as to be located below said operating means and said display means when said first lid member is opened, said stacking means being formed inside of the second lid member when said second lid member is opened in a predetermined manner and being accommodated in said second lid member so as not to be exposed externally of said second lid member when said second lid member is closed, and control means for controlling said sheet feeding means so as to be driven only when said second lid member is opened in the predetermined manner so that said sheet stacking means is formed.

2. The sheet counting machine in accordance with claim 1 which further comprises detecting means for detecting whether or not the second lid member is opened in the predetermined manner and outputting a first detection signal to the control means when said second lid member is opened in the predetermined manner so that said sheet stacking means is formed and a second detection signal to said control means when said second lid member is not opened in the predetermined manner and said sheet stacking is not formed, said operating means being adapted for outputting an operating signal to said control means when said operating means is operated by an operator and said control means controlling said sheet feeding means so as to be driven only when said control means receives said operating signal from said operating means and said first detection signal from said detecting means.

3. The sheet counting machine in accordance with claim 2 which further comprises warning means for outputting a warning display signal to said display means when a warning signal is input from said control means, thereby causing said display means to display a warning, said control means being adapted for outputting said warning signal to said warning means when said second detection signal is input from said detecting means while said operating signal is being input from said operating means.

4. A sheet counting machine in accordance with claim 1 wherein outer surfaces of said first lid member, said second lid member and a body of the sheet counting machine are formed so that the outer surface of said first lid member is flush with that of the body of the sheet counting machine when said first lid member is closed and that the outer surface of said Second lid member is flush with that of the body of the sheet counting machine when said second lid member is closed.

5. A sheet counting machine in accordance with claim 2 wherein outer surfaces of said first lid member, said second lid member and a body of the sheet counting machine are formed so that the outer surface of said first lid member is flush with that of the body of the sheet counting machine when said first lid member is closed and that the outer surface of said second lid member is flush with that of the body of the sheet counting machine when said second lid member is closed.

6. A sheet counting machine in accordance with claim 3 wherein outer surfaces of said first lid member, said second lid member and a body of the sheet counting machine are formed so that the outer surface of said first lid member is flush with that of the body of the sheet counting machine when said first lid member is closed and that the outer surface of said second lid member is flush with that of the body of the sheet counting machine when said second lid member is closed.

7. A sheet counting machine in accordance with claim 1 further comprising a battery case for accommodating a battery and a holder means which detachably accommodates said battery case, an upper surface of said battery case forming a part of said sheet depositing portion when said battery case is accommodated in said holder means.

8. A sheet counting machine in accordance with claim 2 further comprising a battery case for accommodating a battery and a holder means which detachably accommodates said battery case, an upper surface of said battery case forming a part of said sheet depositing portion when said battery case is accommodated in said holder means.

9. A sheet counting machine in accordance with claim 3 further comprising a battery case for accommodating a battery and a holder means which detachably accommodates said battery case, an upper surface of said battery case forming a part of said sheet depositing portion when said battery case is accommodated in said holder means.

10. A sheet counting machine in accordance with claim 4 further comprising a battery case for accommodating a battery and a holder means which detachably accommodates said battery case, an upper surface of said battery case forming a part of said sheet depositing portion when said battery case is accommodated in said holder means.

11. A sheet counting machine in accordance with claim 5 further comprising a battery case for accommodating a battery and a holder means which detachably accommodates said battery case, an upper surface of said battery case forming a part of said sheet depositing portion when said battery case is accommodated in said holder means.

12. A sheet counting machine in accordance with claim 6 further comprising a battery case for accommodating a battery and a holder means which detachably accommodates said battery case, an upper surface of said battery case forming a part of said sheet depositing portion when said battery case is accommodated in said holder means.

13. A sheet counting machine in accordance with claim 7 wherein an outer surface of said battery case is formed so as to be flush with the outer surface of said body of the sheet counting machine when said battery case is accommodated in said holder means.

14. A sheet counting machine in accordance with claim 8 wherein an outer surface of said battery case is formed so as to be flush with the outer surface of said body of the sheet counting machine when said battery case is accommodated in said holder means.

15. A sheet counting machine in accordance with claim 9 wherein an outer surface of said battery case is formed so as to be flush with the outer surface of said body of the sheet counting machine when said battery case is accommodated in said holder means.

16. A sheet counting machine in accordance with claim 10 wherein an outer surface of said battery case is formed so as to be flush with the outer surface of said body of the sheet counting machine when said battery case is accommodated in said holder means.

17. A sheet counting machine in accordance with claim 11 wherein an outer surface of said battery case is formed so as to be flush with the outer surface of said body of the sheet counting machine when said battery case is accommodated in said holder means.

18. A sheet counting machine in accordance with claim 12 wherein an outer surface of said battery case is formed so as to be flush With the outer surface of said body of the sheet counting machine when said battery case is accommodated in said holder means.

* * * * *